US007101286B2

(12) United States Patent
Oury

(10) Patent No.: US 7,101,286 B2
(45) Date of Patent: Sep. 5, 2006

(54) GOLF TEACHING AID

(76) Inventor: Timothy R. Oury, 1808 N. Pace Bend Rd., Apartment 15, Spicewood, TX (US) 78669

( * ) Notice: Subject to any disclaimer, the term of this patent is extended or adjusted under 35 U.S.C. 154(b) by 0 days.

(21) Appl. No.: 10/624,210

(22) Filed: Jul. 22, 2003

(65) Prior Publication Data

US 2004/0142756 A1 Jul. 22, 2004

Related U.S. Application Data

(60) Provisional application No. 60/397,701, filed on Jul. 22, 2002, provisional application No. 60/471,322, filed on May 16, 2003.

(51) Int. Cl.
*A63B 69/36* (2006.01)
*A41D 19/00* (2006.01)

(52) U.S. Cl. ..... 473/205; 473/201

(58) Field of Classification Search ..... 473/201–206; 2/161.2

See application file for complete search history.

(56) References Cited

U.S. PATENT DOCUMENTS

| | | | | | |
|---|---|---|---|---|---|
| 3,508,280 | A * | 4/1970 | Osborn | 2/159 |
| 3,532,344 | A * | 10/1970 | Masstab | 473/205 |
| 4,665,565 | A * | 5/1987 | Odom | 2/161.2 |
| 5,028,050 | A * | 7/1991 | Freyer | 473/205 |
| 5,414,868 | A * | 5/1995 | Crawford | 2/160 |
| 5,462,280 | A * | 10/1995 | Dickerson | 473/205 |
| 6,732,377 | B1 * | 5/2004 | Wilkinson | 2/161.4 |

* cited by examiner

*Primary Examiner*—Nini F. Legesse
(74) *Attorney, Agent, or Firm*—Ross Spencer Garsson; Richard F. Frankeny; Winstead Sechrest & Minick P.C.

(57) ABSTRACT

Right and left hand golf gloves have attachment features and a location feature such that a golfer may place and maintain his or her hands in a correct position on the shaft of a golf club. The location feature allows the golfer to place the palm of his or her first hand on the golf club shaft in a desired position. First and second attachment features, one on each glove, allow golfers to overlay their gloved second hand over their gloved first hand such that they are placed in a proper, relative position while gripping the golf club. The first and second attachment features further allow an attained proper grip to be maintained throughout a golf swing. Third and fourth attachment features, one on each glove, allow the golfer to additionally couple overlapping fingers of his or her grip and maintain their position during the golf swing.

20 Claims, 7 Drawing Sheets

GOLF TEACHING AID

CROSS-REFERENCE TO RELATED APPLICATIONS

The present application claims priority to U.S. Provisional Patent Application Ser. No. 60/397,701, filed Jul. 22, 2002, and 60/471,322, filed May 16, 2003, both of which are incorporated herein by reference.

The present application is related to U.S. patent application Ser. No. 10/624,211, entitled "TOP HAND POSITION LINE GOLF GLOVE AND METHOD FOR USING," filed concurrent herewith, which is incorporated herein by reference.

TECHNICAL FIELD

The present invention relates in general to methods and apparatus for teaching a golfer proper techniques for swinging a golf club.

BACKGROUND INFORMATION

A good golf swing requires certain basic fundamentals to be successful; one being the way the golfer holds the club commonly referred to as the golf grip. The golf grip is the foundation of a good golf swing. Its primary purpose is to insure that the hands and wrist work together in order to transfer the force of the body and leg actions during the swing to the ball.

There are three golf grips commonly used: the Vardon (overlapping) grip (named for Harry Vardon), the ten-finger grip, and the interlocking grip. The difference between these three grips involves the placement of the little finger of the right hand and the index finger of the left (the hands are reversed for left handed players). Research suggests that no particular grip has a significant advantage with respects to the distance and accuracy of golf shots made by beginning golfers. Whether the golfer chooses the overlapping, the interlocking, or the ten finger grip, the fundamental principles required for executing a successful golf swing remain the same.

When a right handed golfer grips a golf club properly, the back of the left hand and the palm of the right hand should align with the club face and should face the target. The golf club is held primarily in the palm of the left hand and the fingers of the right hand. The thumb of the left hand is placed slightly right of the center of a center line of the shaft of the golf club. A "V" is formed by the index finger and the thumb of the left hand when it is placed on the shaft of the golf club. This "V" should substantially point towards the right shoulder. The right hand grips the golf club primarily along the palm side of the fingers. The palm of the right hand rests on the top of the left thumb with the left thumb substantially aligned parallel with the "lifeline" on the palm of the right hand. The golfer's choice to use the interlocking, the overlap, or the ten-finger grip determines the position of the index finger on the left hand relative to the "little finger" of the right hand. The remaining fingers of the right hand close around the grip of the club with the grip resting primarily within the fingers. The index finger and the thumb close around the shaft and gently touch each other. When the right hand is in the proper position, the thumb and the index finger will form another "V". This "V" should also point to the right shoulder. When a golfer's hands grip the golf club properly, his or her hands should be kept firmly but not rigidly together thereby imparting an even, light pressure throughout the hands.

The golf grip has been touted by many professional golf teachers as the most important part of a golfer's golf swing. To execute a good golf swing, a golfer must rotate the golf club back away from the golf ball and then accelerate the club head down and through a line connecting the golf ball with a desired target. For the most part, a golfer wants to cause the golf ball to take a straight path towards a desired target. However, if the club head does not impact the ball squarely, spin may be imparted on the ball which may cause the ball to curve in its path depending on the direction of rotation. The kinematics of the club head during a swing may vary widely depending on how repeatable and true is a golfers swing path. The only contact a golfer has with the golf club is by way of his or her hands, therefore, finding and maintaining a correct golf grip is important in executing a good and repeatable golf swing.

Professional golf instructors know how to position a golfer's hands on the golf club when they are addressing the ball. However, because of the dynamics of the golf swing, many times it is not obvious if the golfer keeps his or her or her hands positioned correctly during the golf swing. The golfer may believe he is keeping his or her hands in a correct position while the ball flight may indicate that the golfer's grip is varying. To develop a correct and repeatable golf swing, the golfer needs to be able to grip the golf club correctly every time he addresses the ball and maintain his or her grip throughout the entire golf swing. If the golfer grips the club correctly and acquires the feel of maintaining the correct position during his or her swing, then muscle memory will develop that will ensure a more repeatable golf swing and thus a more repeatable ball flight.

There is, therefore, a need for a method and apparatus to aid golfers in finding and retaining the correct relative position of their hands at the beginning and throughout the golf swing.

SUMMARY OF THE INVENTION

As a teaching aid, a golfer is provided with golf gloves for their right and left hands. One glove has two attachment features and a location feature and the other glove has two attachment features. The attachment features are made in mating pairs and are designed to couple with sufficient strength that separation after coupling forms tactile and/or audible (preferably both) feedback to a golfer using the golf gloves to grip and swing a golf club. The attachment features allow a golfer to place and maintain his or her gloved hands in a correct position on the shaft of a golf club. The location feature primarily allows the golfer to place the palm of one of his or her hands on the golf club shaft in a desired position. In one embodiment of the present invention, an attachment feature is also placed on the end of the grip of a golf club as the mating element for the glove location feature. For a right handed golfer, the golfer's left hand glove has first and second attachment features and the location feature and the golfer's modified right hand glove has third and fourth attachment features. The location feature allows the right handed golfer to place his or her gloved left hand in a desired position relative to the axis of a golf club shaft. In one embodiment, the attachment feature added to the grip of the golf club couples with the location feature and aids in finding and maintaining the golfer's left hand position on the golf club shaft. Since the attachment features are mated pairs, they allow the golfer to overlay his or her gloved right hand on his or her gloved left hand such that the golfer's are placed in their correct, relative position while gripping the golf club shaft. The coupling of the first attachment feature to the third attachment feature further allows this correct relative position to be maintained throughout a golf swing. The second and fourth attachment features additionally allow the golfer to couple overlapping fingers of his or her grip and maintain their position during the golf swing.

In another embodiment the left hand golf glove has a visible line to aid in positioning a golfs left hand to achieve a proper grip of the golf club. The visible line begins substantially at the "V" formed by the thumb and index finger and proceeds toward a point on the cuff of the golf glove. The visible line is substantially aligned with the lengthwise center line of the grip of the golf club while the "V" points towards the right should when the left hand properly grips the golf club.

The foregoing has outlined rather broadly the features and technical advantages of the present invention in order that the detailed description of the invention that follows may be better understood. Additional features and advantages of the invention will be described hereinafter which form the subject of the claims of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1:
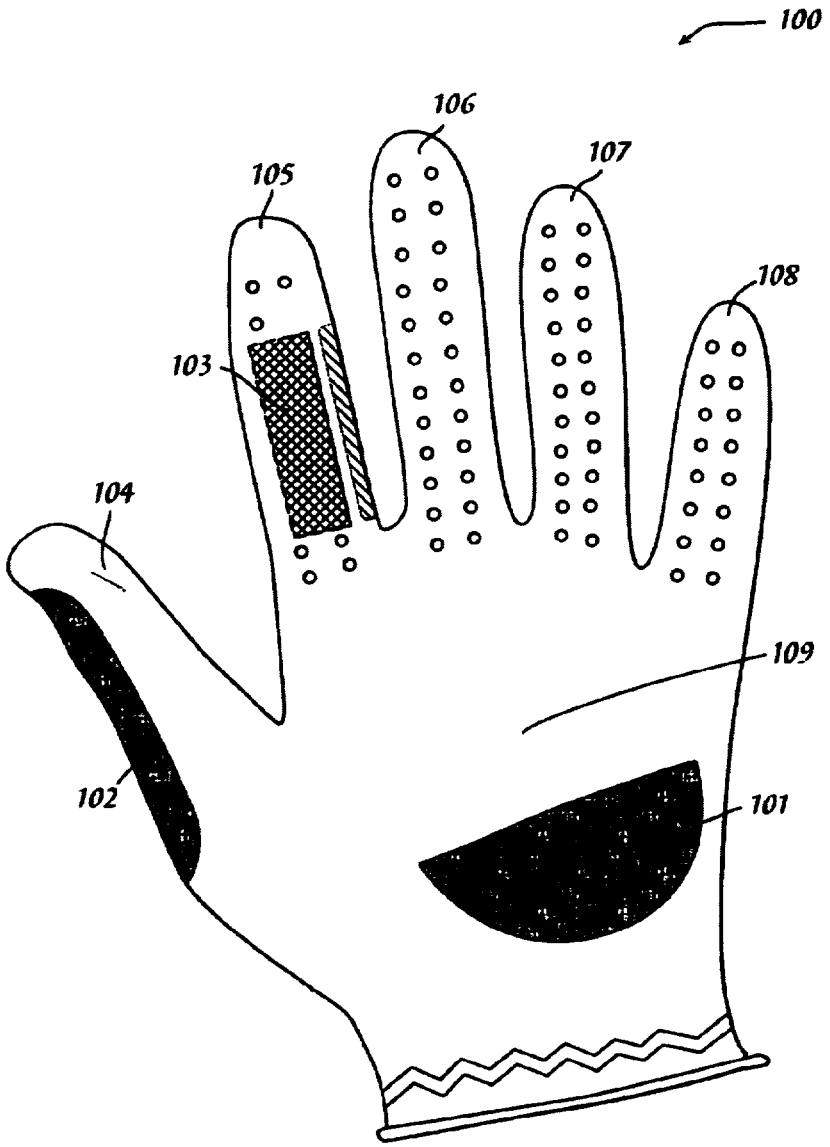
FIG. 1 illustrates a left hand glove for a right handed golfer according to embodiments of the present invention.

In the following description, numerous specific details are set forth to provide a thorough understanding of the present invention. However, it will be obvious to those skilled in the art that the present invention may be practiced without such specific details. For the most part, details concerning specific non-essential materials and the like have been omitted inasmuch as such details are not necessary to obtain a complete understanding of the present invention and are within the skills of persons of ordinary skill in the relevant art.

Refer now to the drawings wherein depicted elements are not necessarily shown to scale and wherein like or similar elements are designated by the same reference numeral through the several views. In the following detailed explanation, golf gloves according to embodiments of the present invention are shown for a right handed golfer. It is understood that a set of gloves may be provided for a left handed golfer according to embodiments of the present invention by reversing the functionality of the right and left hand gloves. Attachment features are provide in mating pairs (e.g., sometimes designated male and female) such that an overlapping pair of attachment features couple together and require a force to separate, wherein separating a coupled attachment feature pair provides a tactile and/or audible (preferably both) feedback that separation has occurred. In the following, either one of a mating pair of attachment features is referred to as simply an attachment feature with the understanding that an attachment feature on a glove for one hand is designed to mate with an attachment feature on the other glove or in one embodiment with an attachment feature on the grip of a modified golf club.

Alignment features are used to aid in attaining a correct grip. While perfect alignment of one element to another is desirable, perfect alignment is rarely attainable. In this disclosure, the term substantially aligned to describe a less that perfect alignment. Substantially aligned means that there is no perceptible misalignment, for example, two lines may be considered substantially aligned if they deviate from parallel by less than 5 degrees. In other cases, a line may be said to substantially begin at a feature where the feature is formed by the intersection of a finger and a thumb on the golfer's hand. For instance, when the end of the line is directed towards the feature and is less than one-half centimeter away, the line would be said to substantially begin at this feature.

In the following, the finger closest to the thumb of a golfer's hand is referred to as the index finger and the finger furthermost from the thumb is referred to as the little finger.

FIG. 1 illustrates a left hand golf glove 100 for a right handed golfer according to embodiments of the present invention. Golf glove 100 has a thumb element 104 and finger elements 105–108. Glove area 109 is above the palm of a left hand inserted in golf glove 100. Location attachment feature 101 may be added to golf glove 100 in glove area 109 above the palm of a left hand inserted in golf glove 100. Location attachment feature 101 is an element of a separable, mating attachment system (e.g., like Velcro® a well known hook and loop material). Location feature 101 may have a corresponding mating attachment feature (not shown) placed on the grip of a golf club. Location feature 101 directs a right handed golfer where to place the shaft of a golf club to facilitate attaining a correct grip of the golf club by the left hand of a right handed golfer. Attachment feature 102 is disposed on an area of thumb element 104 directly above the top of the thumb of a left hand inserted in golf glove 100. Attachment feature 103 is disposed on finger element 105 in an area below the palm surface of a finger of a left hand inserted in golf glove 100. Attachment features 102 and 103 are also elements of a separable attachment system (e.g., like Velcro®). One of ordinary skill in the art will recognize that other separable attachment systems such as magnets or non-permanent adhesives, snaps, etc. may be used for attachment features 101–103 and still be within the scope of the present invention. Most of attachment feature 103 is shown dotted indicating it is on the glove surface above the top of finger element 105 which is not visible in this view.

Figure 2:
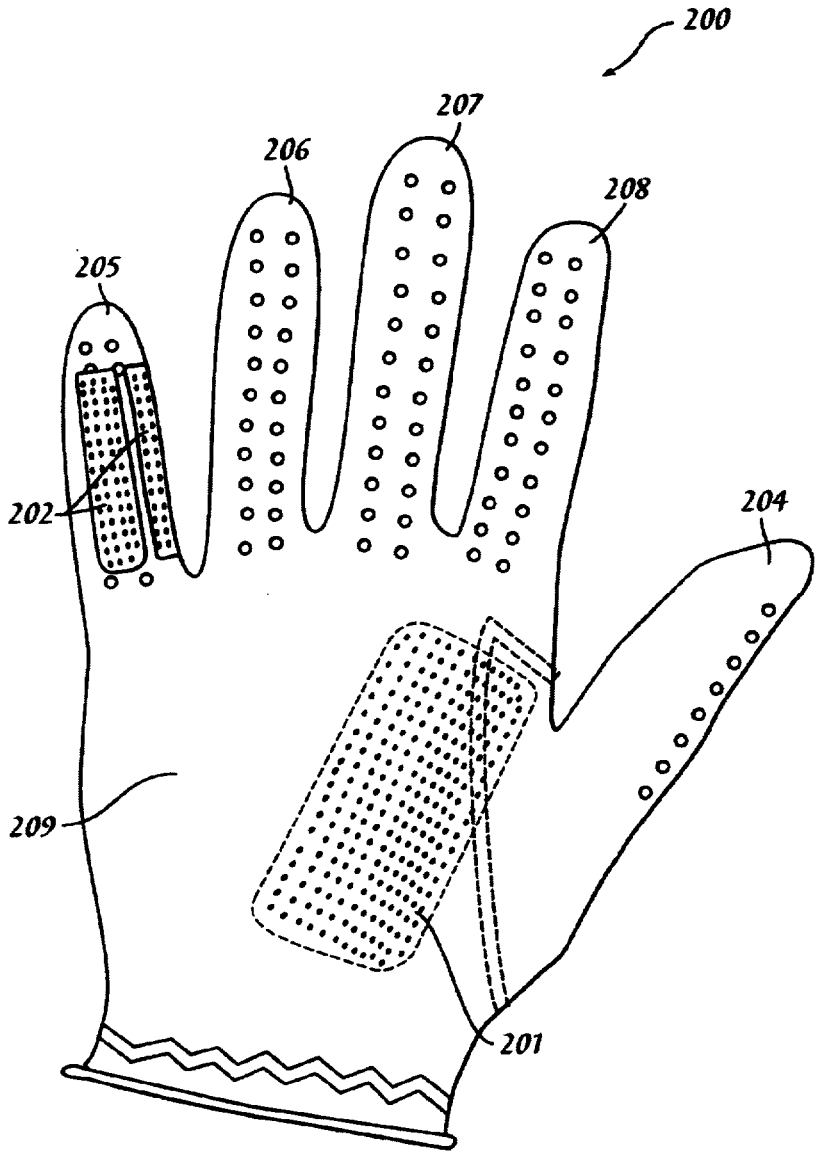
FIG. 2 illustrates a right hand glove for a right handed golfer according to embodiments of the present invention.

FIG. 2 illustrates a right hand golf glove 200 for a right handed golfer according to embodiments of the present invention. Right hand golf glove 200 has a thumb element 204 and finger elements 205–208. Glove area 209 is directly above the palm of a right hand inserted in golf glove 200. Attachment feature 201 is an element added to golf glove 200 in glove area 209 above the palm of a right hand inserted in golf glove 200. Attachment feature 201 is an element of a separable attachment system (e.g., like Velcro®). Attachment feature 201 is the mating element to attachment feature 102 shown in FIG. 1 and is positioned to facilitate finding and maintaining a correct relationship between the right and left hands of a golfer when gripping a golf club using a left handed golf glove 100 and a right handed golf glove 200. Attachment feature 202 is disposed on finger element 205 in an area directly below the palm surface of a finger of a hand inserted in golf glove 200. Attachment features 201 and 202 are also elements of a separable attachment system (e.g., like Velcro®). One of ordinary skill in the art will recognize that other separable attachment systems such as magnets or non-permanent adhesives, snaps, etc. may be used for attachment features 201–202 and still be within the scope of the present invention.

Figure 3:
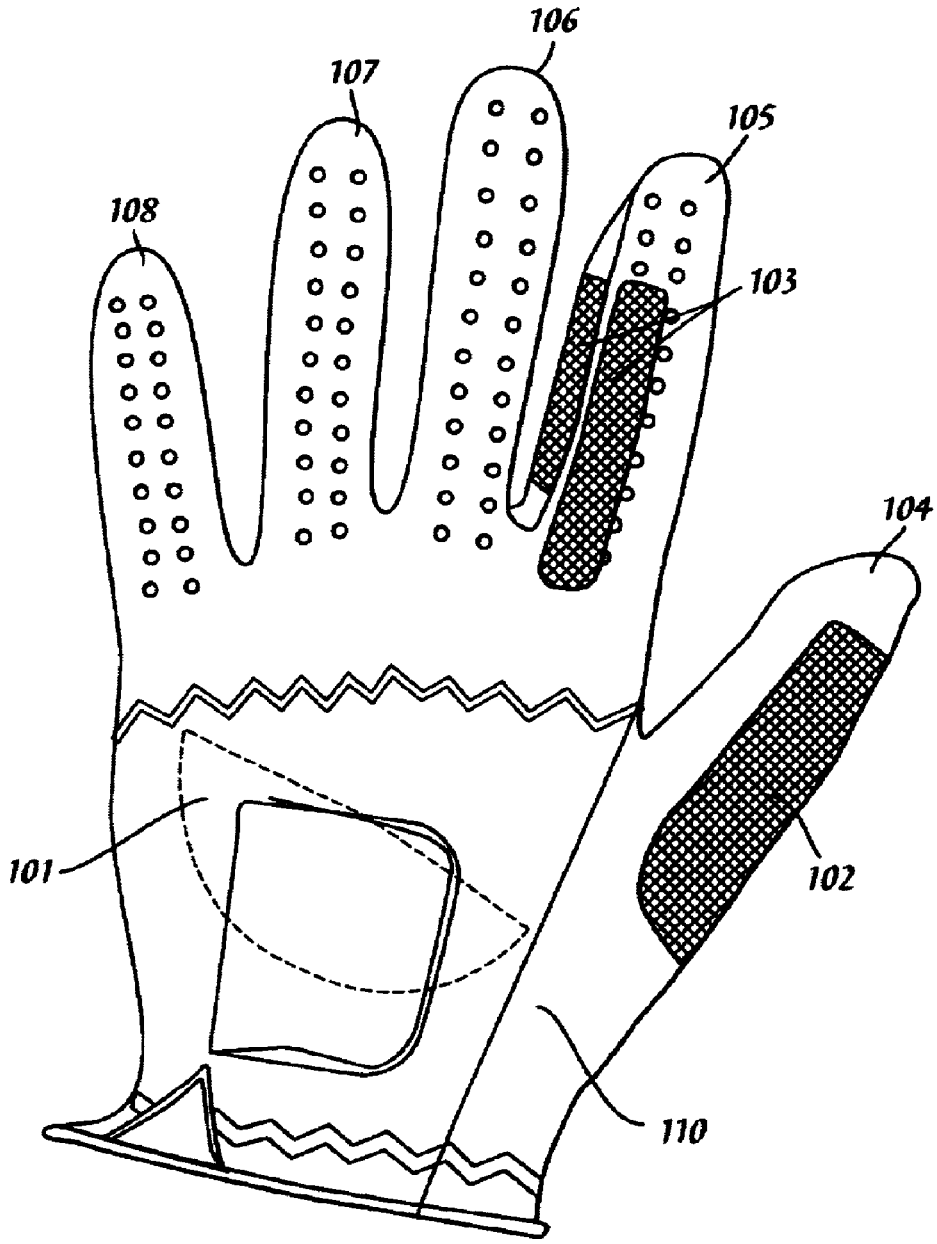
FIG. 3 illustrates another view of a left hand glove for a right handed golfer according to embodiments of the present invention.

FIG. 3 illustrates another view of a left hand golf glove 100 for a right handed golfer according to embodiments of the present invention. FIG. 3 is a knuckle side view of left hand golf glove 100. Attachment feature 101 and a portion of attachment feature 103 are shown dotted as they are on the palm surfaces of golf glove 100 which are each not visible in this view. The opposite side of finger elements 105–108 are also shown in FIG. 3. An optional alignment feature 110 is also shown in FIG. 3. Alignment feature 110 may be added, as shown, to left handed golf glove 100 for a right handed golfer to aid in positioning the left hand on the grip of a golf club (not shown) relative to the club head of the golf club. It should be noted that a subset of the alignment feature may be used on left hand gloves and right hand gloves. It should also be noted that a single glove having only alignment feature 110 may be used as a teaching aid.

Figure 4A:
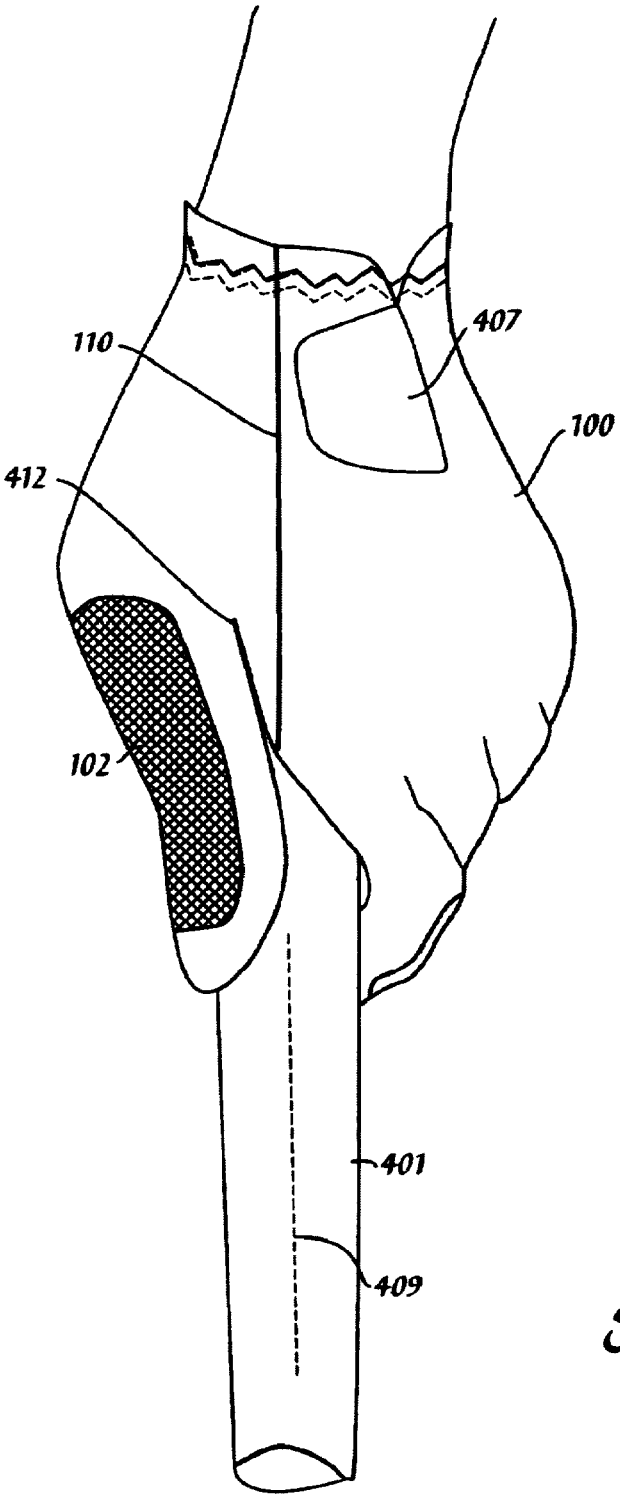
FIG. 4A illustrates the left hand of a right handed golfer gripping a golf club using a left handed glove according to embodiments of the present invention.

FIG. 4A illustrates the left hand of a right handed golfer gripping a golf club grip 401 using a left handed golf glove 100 according to embodiments of the present invention. Attachment element 102 is shown in a position relative to a center line 409 of golf club grip 401. Center line 409 is a real or imagined line drawn parallel to the center line through the length of the club shaft 402 (see FIG. 4B) and substantially perpendicular to a line parallel to the face 410 of the club head 403 (see FIG. 4B). The left hand inserted in left handed golf glove 100 is positioned such that alignment feature 1110 is substantially aligned with center line 409. Positioning attachment feature 102 using alignment feature 110, further facilitates placing a right handed golfer's left hand on the golf club grip using golf glove 100 according to embodiments of the present invention. Alignment feature 110 is placed to be substantially in line with the center line 409 of grip 401. Clasp 407 is a standard element used to secure golf glove 100 to a hand inserted into golf glove 100.

Figure 4B:
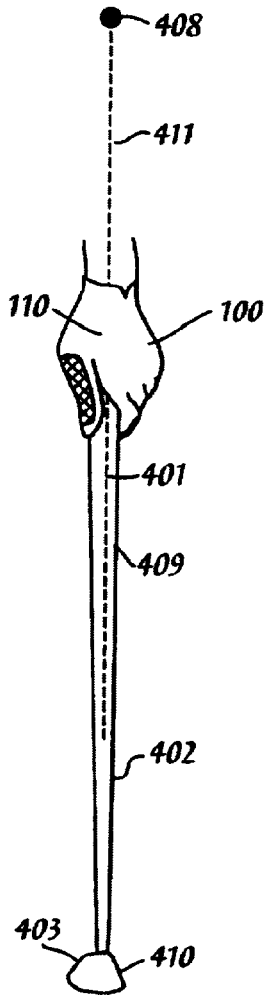
FIG. 4B illustrates the position of the left hand of a right handed golfer gripping a golf club, using a left handed golf glove according to embodiments of the present invention, relative to the grip, shaft and club head of the golf club.

FIG. 4B is a detailed view illustrating the position of the left hand of a right handed golfer gripping a golf club 402, using a left handed golf glove 100 according to embodiments of the present invention. FIG. 4B shows the position of the left hand relative to the grip 401 and club head 403 of golf club 402. Alignment feature 110 is aligned with center line 409 which is substantially perpendicular to a line (not shown) parallel with club face 410. Alignment feature 110 is also shown extended with imaginary line 411 to a point 408 along the forearm (not shown) of a golfer using golf glove 100 to grip golf club 402. This aids in positioning the gripped golf club 402 relative to the golfer's upper body when using embodiments of the present invention.

Figure 5:
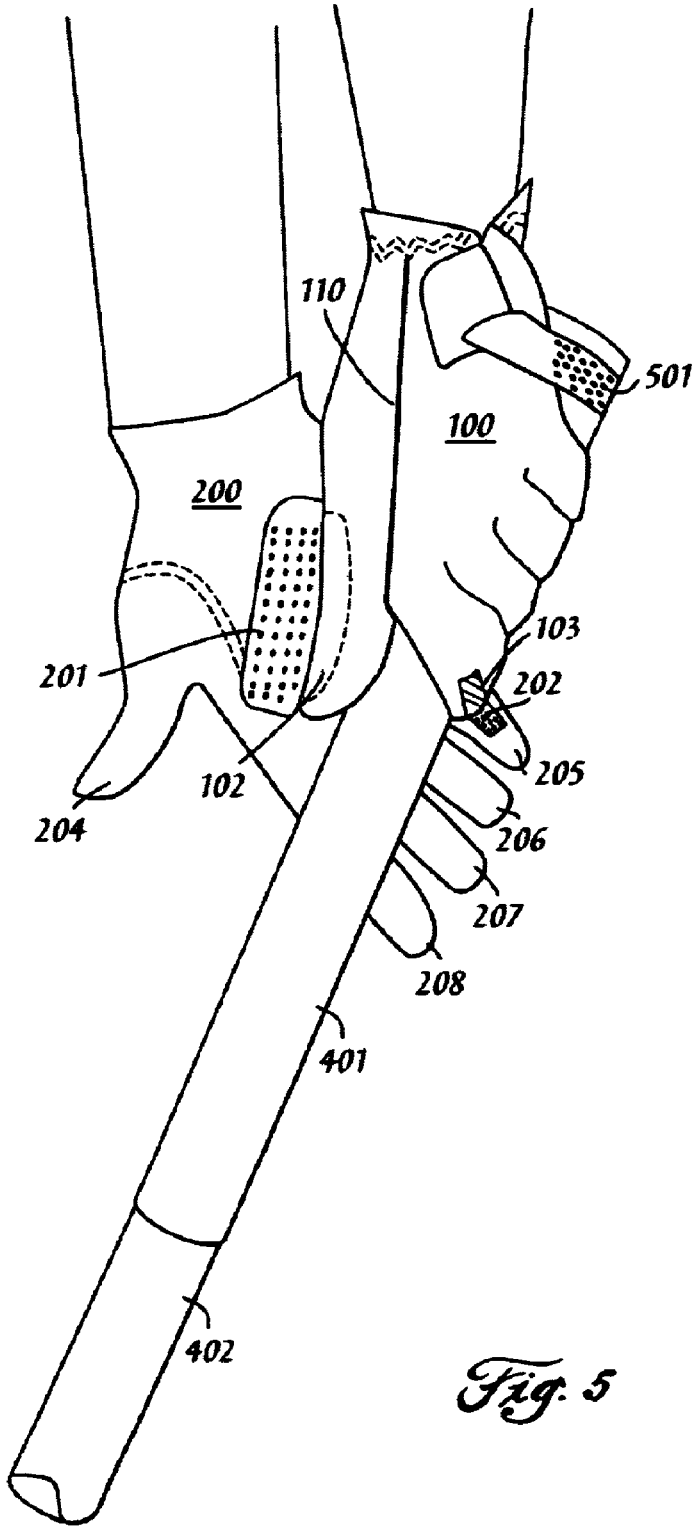
FIG. 5 illustrates a side view of a right handed golfer overlaying the gloved right hand with the gloved left hand while gripping a modified golf grip using modified golf gloves according to embodiments of the present invention.

FIG. 5 illustrates a side view of a right handed golfer overlaying the gloved right hand (golf glove 200) with the gloved left hand (golf glove 100) while gripping a modified golf grip 401 on golf club 402 according to embodiments of the present invention. Golf grip 401 may be modified with attachment feature 501. Attachment feature 501 is circumferentially attached around the end of golf grip 401. A portion of the circumference of attachment feature 501 is designed to couple with corresponding location feature 101 (not shown in this view). While alignment feature 110 is used to place the left hand in golf glove 100 in a desired position relative to grip 401, the coupling of attachment feature 501 with location feature 101 functions to hold this attained position during an actual golf swing.

Attachment feature 201 on golf glove 200 couples with attachment feature 102 when the hands in golf glove 200 and golf glove 100 are properly placed when gripping golf grip 401. Attachment element 202 on golf glove 200 likewise couples with attachment feature 103 on golf glove 100 when fingers in finger element 205 and finger element 105 overlap completing the grip of golf club 402. All the features of golf gloves 100 and 200 and modified grip 401 operate to find (e.g., alignment features 101, 501, and 110) and maintain (e.g., attachment features 102, 202, 501, 103) a golfer's hands in a desired, correct position during the golf swing while providing tactile and/or audible feedback (preferably both) if the golfer's grip moves thereby separating (completely or partially) any coupled attachment features (e.g., 102 and 201, 103 and 202, or 101 and 501).

Figure 6:
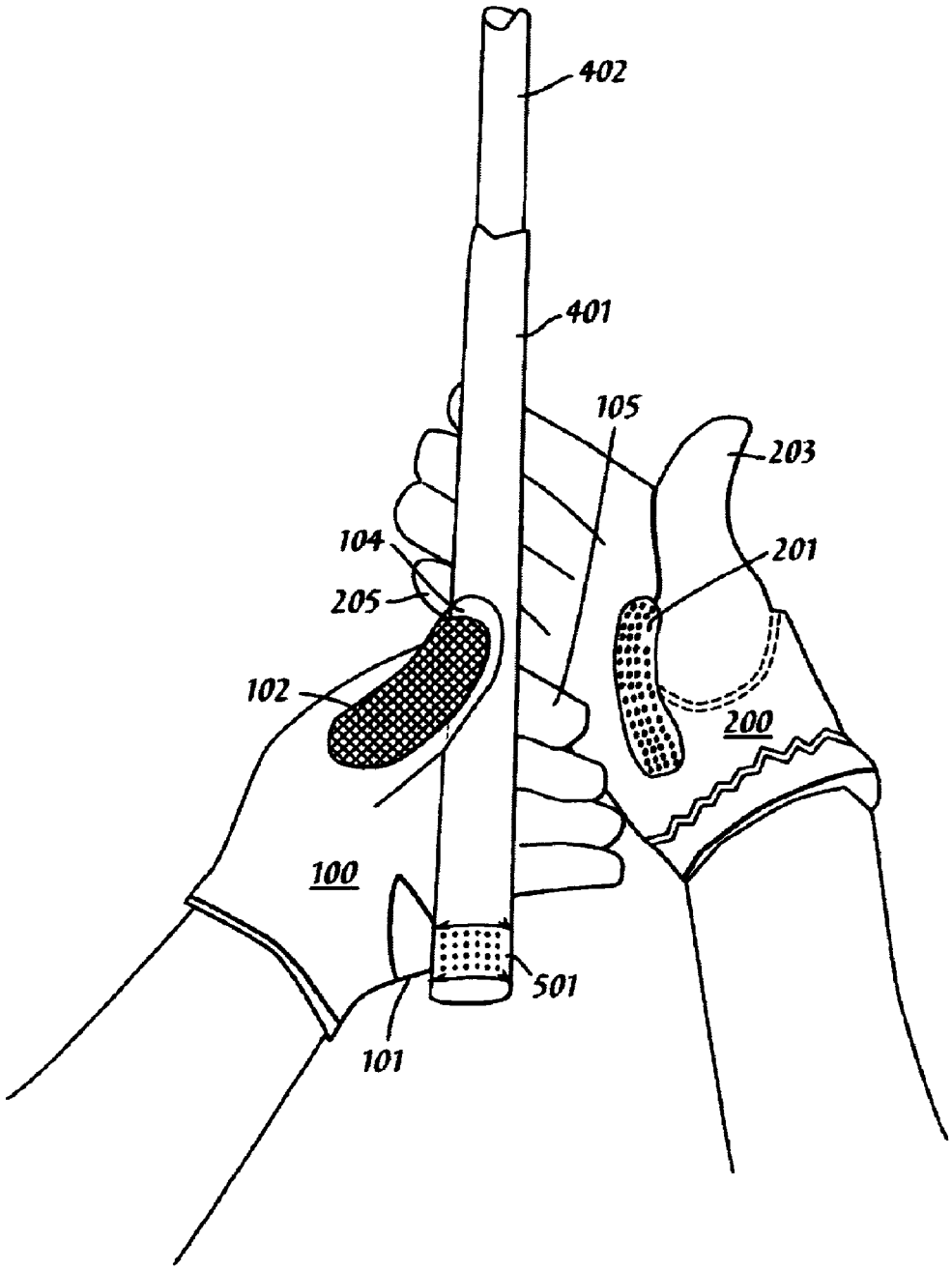
FIG. 6 illustrates another view of overlaying the gloved right hand with the gloved left hand by a right handed golfer while gripping a modified golf grip and modified golf gloves according to embodiments of the present invention.

FIG. 6 illustrates another view of overlaying the gloved right hand (golf glove 200) on the gloved left hand (golf glove 100) by a right handed golfer (arms only shown) while gripping a golf grip 401 according to embodiments of the present invention. Golf club 402 has a golf grip with attachment feature 501. Left hand golf glove 100 is placed such that attachment feature 101 couples with a mating element (not visible) of attachment feature 501. Attachment feature 102 is positioned on grip 401 by placing thumb element 104 using the aid of alignment feature 110 (not shown in this view). Right hand golf glove 200 is placed over left hand golf glove 100 coupling attachment features 102 and 201. Attachment features 202 and 103 (not shown in this view) couple when respective finger elements 205 and 105 overlap completing the grip of golf club 402.

Figure 7A:
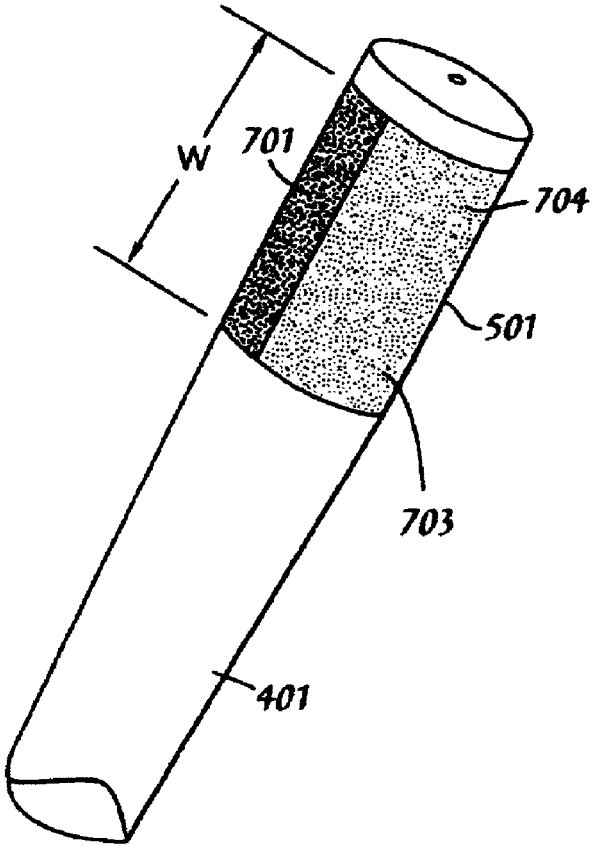
FIG. 7A illustrates a modification of a golf grip according to embodiments of the present invention.

FIG. 7A illustrates the modification of a golf grip 401 using attachment feature 502 according to embodiments of the present invention. Attachment feature 501 has two sections, coupling section 701 and non-coupling section 704. The limited size of coupling section 701 insures that coupling attachment feature 501 to attachment feature 101 (not shown) places the gloved left hand (using golf glove 100) of a right handed golfer in a desired position relative to the face 410 (not shown) of golf club 402 (not shown). See FIG. 4B. Attachment feature 501 has a width 703.

Figure 7B:
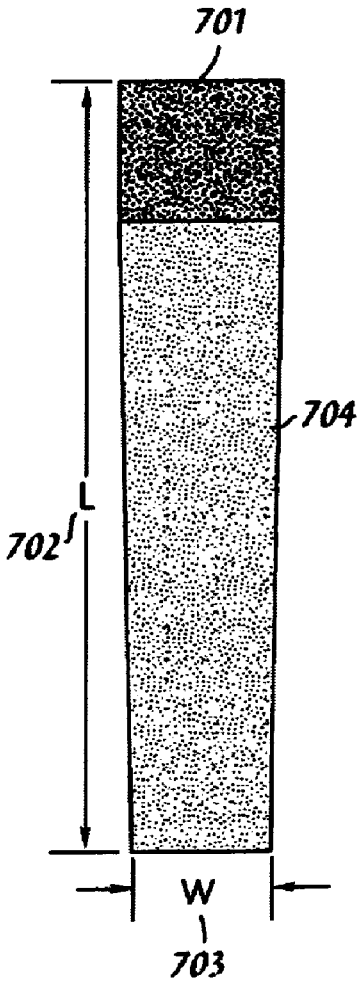
FIG. 7B illustrates details of the attachment element used to modify the golf grip of FIG. 7A according to embodiments of the present invention.

FIG. 7B illustrates details of the attachment feature 501 used to modify the golf grip 401 of FIG. 7A according to embodiments of the present invention. FIG. 7B illustrates the length 702 and width 703 relative to coupling section 701 and non-coupling section 704.

Although the present invention and its advantages have been described in detail, it should be understood that various changes, substitutions and alterations can be made herein without departing from the spirit and scope of the invention as defined by the appended claims.

What is claimed is:

1. A golf teaching aid comprising:

a first golf glove, having a first attachment feature on a glove surface area above a top of a thumb of a first hand inserted into said first golf glove and having a lengthwise elongated first location feature disposed on a glove surface area above a palm surface of said first hand inserted into said first golf glove, said first location feature extending lengthwise from below a base of a little finger of said first hand laterally to a position on the palm surface below a base of a thumb of said first hand said first location feature positioned for locating a shaft of a golf club to said palm surface of said first hand for a correct grip when said golfer grips said golf club by placing said shaft of said golf club onto said first location feature; and a second golf glove having a second attachment feature on a glove surface area above the palm surface of a second hand inserted into said second golf glove, wherein said first attachment feature couples to said second attachment feature when said second hand inserted in said second golf glove overlays said first hand inserted in said first golf glove while when correctly gripping said golf club.

2. The golf teaching aid of claim 1, wherein said first golf glove has a third attachment feature disposed on a glove surface area above and adjacent to a top surface of said index finger of said first hand when inserted into said first golf gloves, said third attachment feature having a first portion extending a lengthwise distance from a first point to a second point on said top surface of said index finger of said first hand and a second portion extending a lengthwise distance from a third point to a fourth point on a side surface of said index finger of said first hand, wherein said first point is adjacent to a junction between said index finger and a middle finger of said first hand, said second point is substantially at a middle knuckle of said index finger of said first hand, said third point is adjacent to said middle finger and adjacent to said junction between said index finger and said middle finger of said first hand, and said fourth point is substantially at said middle knuckle of said index finger.

3. The golf teaching aid of claim 2, wherein said second golf glove has a fourth attachment feature disposed on a glove surface area above and adjacent to a palm surface of a little finger of said second hand inserted into said second golf glove, said fourth attachment feature having a first portion extending a lengthwise distance from a first point to a second point on said palm surface of said little finger and a second portion extending a lengthwise distance from a third point to a fourth point on a side surface of said little finger adjacent to said ring finger, wherein said first point adjacent to a junction between said little finger and a ring finger of the second hand, said second point past a middle knuckle but not to a tip area beyond a last knuckle of said little finger, said third point is adjacent to said junction between said little finger and said ring finger of the second hand, and said fourth point is past said middle knuckle but not to said tip area beyond said last knuckle of said little finger.

4. The golf teaching aid of claim 3, wherein said third attachment feature couples to and is retained by said fourth attachment feature when said little finger overlays said index finger as said second hand inserted in said second golf glove overlays said first hand inserted in said first golf glove while gripping a golf club.

5. The golf teaching aid of claim 3, wherein said third and fourth attachment features are mating elements selected from a group consisting of a hook and loop attachment system, a magnetic attachment system, or a selective, separable adhesive based attachment system.

6. The golf teaching aid of claim 1, wherein said first and second attachment features are mating elements selected from a group consisting of a hook and loop attachment system, a magnetic attachment system, or a selective, separable adhesive based attachment system.

7. The golf teaching aid of claim 1 further comprising a golf club with a modified golf grip having a fifth attachment feature for selectively coupling to said first location feature to align said first hand inserted in said first golf glove when gripping said modified golf grip.

8. A method of teaching a golfer how to attain and maintain a correct golf grip on a golf club comprising the steps of:

inserting said golfer's first hand into a first golf glove having a first attachment feature on a first glove surface area and having a lengthwise elongated first location feature extending lengthwise from below a base of a little finger of said first hand laterally to a position on the palm surface below a base of a thumb of said first hand;

inserting said golfer's second hand into a second golf glove having a second attachment feature on a second glove surface area;

placing said first hand inserted in said first golf glove in a correct grip by placing said shaft of said golf club onto said first location feature; and placing said second hand inserted in said second golf glove over said first hand inserted in said first golf glove such that said first attachment feature couples to said second attachment while gripping said golf club.

9. The method of claim 8 further comprising the step of swinging said golf club while keeping said first and second attachment features in contact.

10. The method of claim 9 further comprising the step of contacting a golf ball with a surface of the head of said golf club during said swinging step.

11. A method of teaching a golfer how to attain and maintain a correct golf grip on a golf club comprising:

inserting said golfer's first hand into a first golf glove having a first attachment feature disposed on a first glove surface area and having a lengthwise elongated first location feature extending lengthwise from below a base of a little finger of said first hand laterally to a position on the palm surface below a base of a thumb of said first hand;

inserting said golfer's second hand into a second golf glove having a second attachment feature on a glove surface area above a palm surface of said second hand inserted in said second golf glove;

placing said first hand inserted in said first golf glove in a correct grip by placing said shaft of said golf club onto said first location feature; and placing said second hand inserted in said second golf glove over said first hand inserted in said first golf glove such that said first attachment feature couples to said second attachment while gripping said golf club.

12. The method of claim 11, wherein said desired position on the grip of the golf club is determined by said first location feature on said glove surface area above a palm surface of said first hand inserted into said first golf glove.

13. The method of claim 12, wherein said first golf glove has a third attachment feature disposed on a glove surface area above and adjacent to a top surface of said index finger of said first hand when inserted into said first golf glove, said third attachment feature having a first portion extending a lengthwise distance from a first point to a second point on said top surface of said index finger of said first hand and a second portion extending a lengthwise distance from a third point to a fourth point on a side surface of said index finger of said first hand, wherein said first point is adjacent to a junction between said index finger and a middle finger of said first hand, said second point is substantially at a middle knuckle of said index finger of said first hand, said third point is adjacent to said middle finger and adjacent to said junction between said index finger and said middle finger of said first hand, and said fourth point is substantially at said middle knuckle of said index finger.

14. The method of claim 13, wherein said second golf glove has a fourth attachment feature disposed on a glove surface area above and adjacent to a palm surface of a little finger of said second hand inserted into said second golf glove, said fourth attachment feature having a first portion extending a lengthwise distance from a first point to a second point on said palm surface of said little finger and a second portion extending a lengthwise distance from a third point to a fourth point on a side surface of said little finger adjacent to said ring finger, wherein said first point adjacent to a junction between said little finger and a ring finger of the second hand, said second point Past a middle knuckle but not to a tip area beyond a last knuckle of said little finger, said third point is adjacent to said junction between said little finger and said ring finger of the second hand, and said fourth point is past said middle knuckle but not to said tip area beyond said last knuckle of said little finger.

15. The method of claim 14 further comprising the step of coupling said third attachment feature to said fourth attachment feature when said little finger overlays said index finger as said second hand inserted in said second golf glove overlays said first hand inserted in said first golf glove while gripping a golf club.

16. The method of claim 15 further comprising the step of swinging said golf club while keeping said first and second attachment features coupled, said third and fourth attachment features coupled, and said first location feature coupled to a fifth attachment feature on a grip of said golf club.

17. The method of claim 16 further comprising the step of contacting a golf ball with a surface of the head of said golf club during said swinging step.

18. The method of claim 14, wherein said third and fourth attachment features are mating elements selected from a group consisting of a hook and loop attachment system, a magnetic attachment system, or a selective, separable adhesive based attachment system.

19. The method of claim 11, wherein said first and second attachment features are mating elements selected from a group consisting of a hook and loop attachment system, a magnetic attachment system, or a selective, separable adhesive based attachment system.

20. The method of claim 11 further comprising the step of swinging said golf club while keeping said first and second attachment features in contact.

* * * * *